US006279543B1

(12) United States Patent
Niethammer et al.

(10) Patent No.: US 6,279,543 B1
(45) Date of Patent: Aug. 28, 2001

(54) PRESSURE REGULATOR FOR CONTROLLING THE PRE-INJECTION QUANTITY OF FUEL IN INTERNAL COMBUSTION ENGINES

(75) Inventors: Bernd Niethammer, Nürtingen; Steffen Martin, Niederfrohna; Martin Lenk, Chemnitz, all of (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/425,854

(22) Filed: Oct. 22, 1999

(30) Foreign Application Priority Data

Oct. 23, 1998 (DE) ..... 198 48 904

(51) Int. Cl.[7] ..... F02M 37/04
(52) U.S. Cl. ..... 123/506
(58) Field of Search ..... 123/506, 446

(56) References Cited

U.S. PATENT DOCUMENTS 5,622,152 * 4/1997 Ishida ..... 123/446
5,662,087 * 9/1997 McCandless ..... 123/506
5,664,545 * 9/1997 Kato ..... 123/496
5,720,261 * 2/1998 Sturman et al. ..... 123/446
5,738,075 * 4/1998 Chen et al. ..... 123/446
5,865,156 * 2/1999 Feucht et al. ..... 123/446
5,878,720 * 3/1999 Anderson et al. ..... 123/446
6,112,721 * 9/2000 Kouketsu ..... 123/506

* cited by examiner

*Primary Examiner*—Thomas N. Moulis
(74) *Attorney, Agent, or Firm*—Robert W. Becker & Associates; Robert W. Becker

(57) ABSTRACT

The invention relates to a pressure regulator for controlling a pre-injection quantity of fuel in internal combustion engines, preferably Diesel engines, with a control piston which is connected in a first position with a relief valve for producing a decreased pressure on an injection valve and which, in a second, subsequent position can be separated from the relief valve for producing a higher pressure.

14 Claims, 7 Drawing Sheets

PRESSURE REGULATOR FOR CONTROLLING THE PRE-INJECTION QUANTITY OF FUEL IN INTERNAL COMBUSTION ENGINES

BACKGROUND OF THE INVENTION

The present invention relates to a pressure regulator for controlling a pre-injection quantity of fuel in internal combustion engines, preferably Diesel engines.

For a reliable and clean mixture formation within the combustion chamber, today's internal combustion engines, Diesel engines in particular, require an injection process consisting of several individual injection actions. These injection processes are divided into pre-injection and main injection of the fuel quantity. For producing the pre-injection fuel quantity, a control unit is employed which requires a high-cost electronic control system and which shows energetic losses. Frequently, a damper is employed for producing the pre-injection fuel quantity. This damper, however, cannot be fully utilized in each step of the operation. The reason for this is that the response time of the control hydraulic is too long in the event of small injection quantities due to the design of the control elements and a small pre-injection quantity can, therefore, be produced only with the help of a significant control-technical structural design and expenditure.

Therefore, it is an object of the present invention to provide the pressure regulator of the aforementioned kind such that a pre-injection quantity of fuel can be produced in each step of the operation without the necessity of a high control-technical structural design and expenditure.

SUMMARY OF THE INVENTION

This object is solved by the inventive pressure regulator by providing the pressure regulator with a control piston which is connected in a first position with a relief valve for producing a decreased pressure on an injection valve and which, in a second, subsequent position can be separated from the relief valve for producing a higher pressure.

With the inventive pressure regulator a two stage operation is created by an initial signal by an additional switching operation by means of a simple sliding control while the duration of the control action of the control piston remains constant. For as long as the control piston is connected to the relief valve during the first motion phase, only a decreased pressure acts upon the control piston and thereby on the injection valve arranged downstream. As soon as the connection to the relief valve is separated, an increased pressure acts upon the control piston and leads to a further opening of the injection valve. Thus, the desired fuel quantity can be conveyed at a constant duration of the control action and of the exerted pressure. A precision control of the pre-injection quantity in all steps of the operation without high control-technical design and expenditure is ensured by the inventive pressure regulator. A damper can be omitted because of the pressure stage so that the injection can occur with precision and quickly. This pre-injection moreover results in a high smoothness of running of the internal combustion engine and in a decrease of the exhaust gas emissions.

BRIEF DESCRIPTION OF THE DRAWINGS

The object and advantages of the present invention will appear more clearly from the following specification in conjunction with the accompanying schematic drawings in which.

DESCRIPTION OF PREFERRED EMBODIMENTS

The present invention will now be described in detail with the aid of several specific embodiments utilizing FIGS. 1 through 9.

Figure 1:
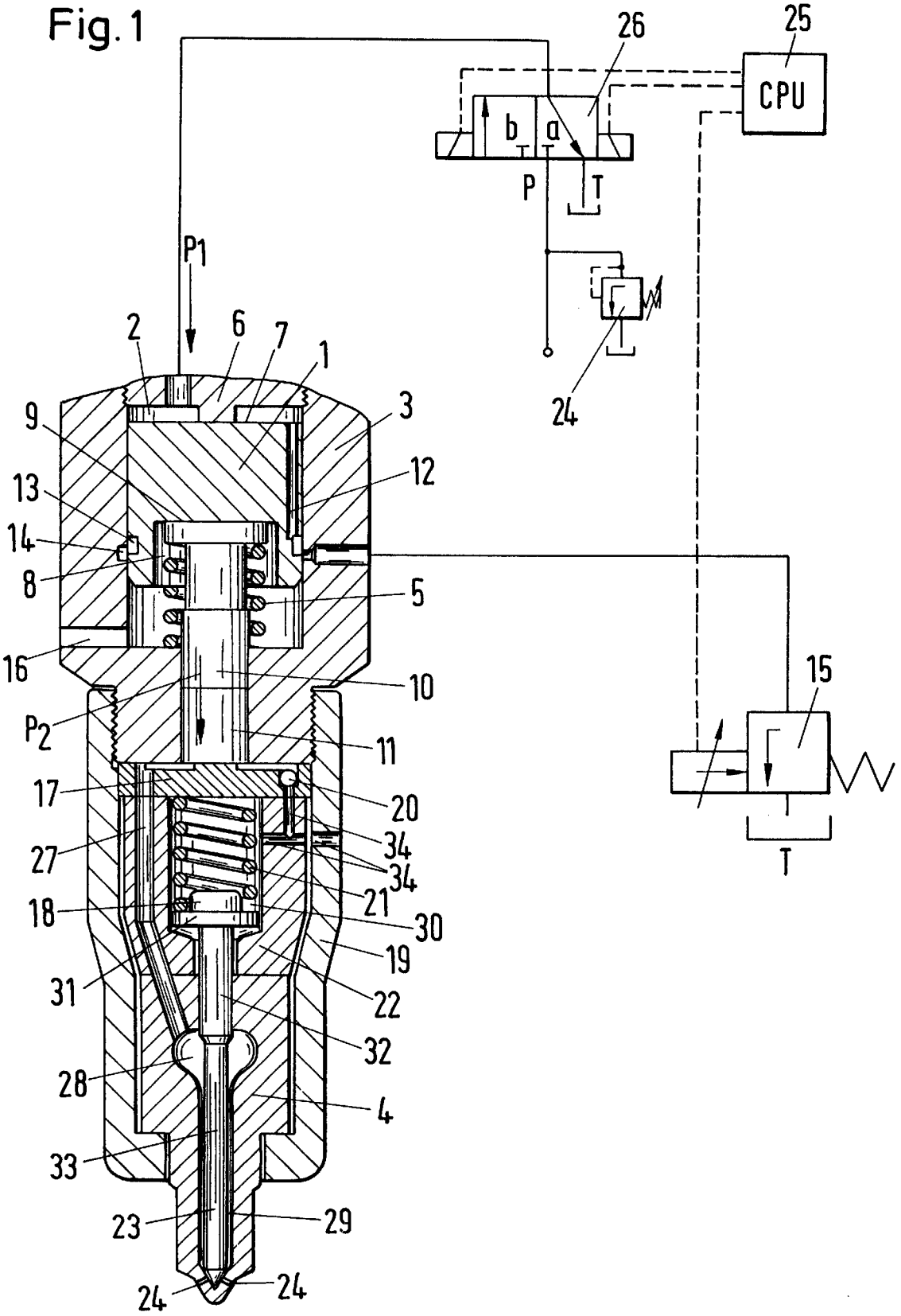
FIG. 1 shows a longitudinal section of an inventive pressure regulator.
Figure 9:
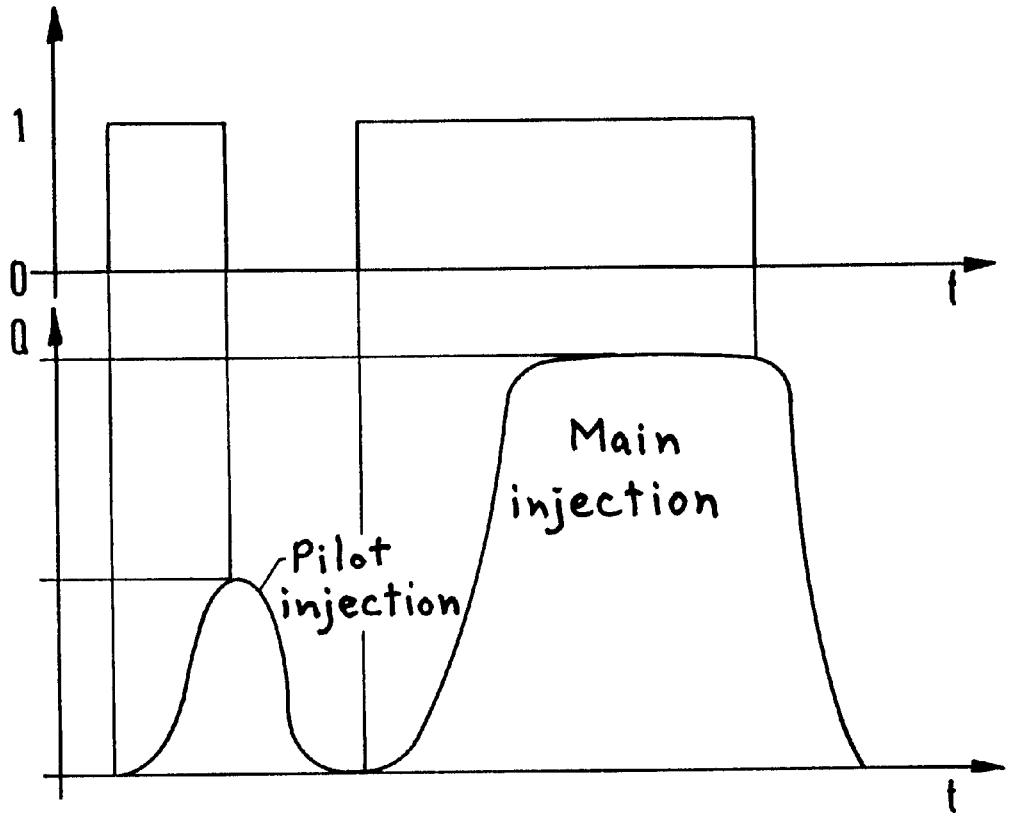
FIG. 9 shows a diagram of a time sequence of an injection process.

The pressure regulator is utilized for activating an injection valve 4 of internal combustion engines, Diesel engines, in particular. It is a feature of the pressure regulator that a specified quantity of fuel can be conveyed into the combustion chamber of the engine while the duration of the control action and the exerted pressure remain constant. FIG. 9 shows an injection process. First, a pilot injection occurs, triggered by a switching pulse of the engine control. Subsequent to a time t, the pilot(pre-)injection is terminated by a cut-off pulse and the main injection of the fuel is started after a time t by a switching pulse. The main injection has a longer duration than the pre-injection. Also, significantly more fuel is injected during the main injection than during the pre-injection stage. The pressure regulator has a control piston 1 which is displaceable within a bore 2 of a housing means 3. When the injection valve 4 is closed (FIG. 1), the control piston 1 abuts a stop 6 under the force of a spring 5. The stop 6 can be adjustable, e.g., embodied as a screw member or as an insertable socket member. It is also possible to provide as a stop 6 a retaining ring which is inserted in the wall of the bore 2. FIG. 1 shows the control piston 1 in a starting position, displaced by the force of the spring 5. In this starting position, a valve body 23 of the injection valve 4 closes off nozzle openings 24. The fuel is fed via the nozzle openings 24 to the combustion chamber.

The control piston 1 is provided with a piston surface 7 which is acted upon by a system pressure $p_1$. The control piston 1 is provided at the opposite side with a recess 8 the bottom 9 of which is abutted by a pressure transferring/intensifying piston 10. It has a smaller diameter than the control piston 1 and projects into a second bore 11 of the housing means 3. The second bore 11 has a smaller diameter than the bore 2. The pressure $p_1$ is intensified by the pressure intensifying piston 10 creating the larger pressure $p_2$, which acts upon the injection valve 4.

The control piston 1 has a connecting bore 12 extending from the piston surface 7 to an annular groove 13 within the peripheral surface of the control piston 1. In the illustrated embodiment, the connecting bore 16 extends parallel to the axis of the control piston 1. The bore opening 16 can, of course, be arranged differently within the control piston 1. When the control piston 1 abuts the stop 6 in the starting position, the annular groove 13 communicates with a second annular groove 14 within the bore 2. The second annular groove 14 is line-connected to a relief valve 15 which is preferably adjustable. The relief valve 15 can be provided at any suitable location within the housing means 3, or also externally of the housing means 3. The relief valve 15 is connected to a control unit 25 controlling a pilot valve 26 which can be embodied as a piezo valve. The still to be described switching operation of the pressure regulator is activated by the pilot valve 26. The pilot valve 26 is connected to a pressure source which is controlled by a control valve 24 by which the in-feed pressure is set. The pilot valve 26 and the control valve 24 can be controlled directly, but also indirectly by the engine control. The control unit 25 controls and monitors the operation of the pilot valve 26 and the control valve 24 and is connected to the engine control. In the starting position of the control piston 1 illustrated in FIG. 1, the bore 2 is relieved to the tank T via the pilot valve 26.

When the internal combustion engine is operated, the pilot valve 26, controlled by the control unit 25, is switched such that the hydraulic medium is pressurized. The system pressure $p_1$ acts upon the piston surface 7. The recess 8 opposite the piston surface 7 is relieved of pressure and is connected to the atmosphere by the bore 16 in the housing means 3. The system pressure $p_1$ acts upon the relief valve 15 via the connecting bore 12 and the annular groove 13 within the control piston 1 and via the second annular groove 14 within the housing means 3. The relief valve is set such that a prescribed decreased pressure is created by which the control piston 1 is displaced against the force of the compression spring 5. The air within the recess 8 and within the space containing the spring is displaced through the bore 16. The control piston 1 displaces the pressure intensifying piston 10 whereby the fuel within the second bore 11 is pressed into a channel 27 by a fixedly connected distribution plate 17. The channel 27 is provided within an insertion member 22 which is received by a threaded socket member 19. The threaded socket member 19 is screwed onto the housing means 3 and receives the injection valve 4 which projects out of the threaded socket member 19. The distribution plate 17 is clamped by means of the threaded socket member 19 between the insertion member 22 and the housing means 3. The channel 27 extends from the distribution plate 17 through the insertion member 22 and the injection valve 4 to an injection chamber 28 which is penetrated by the valve body 23. An axial bore 29 is provided, adjoining the injection chamber 28 and leading to the nozzle openings 24 and it has a larger diameter than the portion of the valve body 23 which projects into the axial bore 29. The valve body 23 projects into a central receiving cavity 30 of the insertion member 22. The central receiving cavity 30 is closed off at the opposite side by the distribution plate 17. One end of a compression spring 21 is supported on the distribution plate 17 and its other end rests on a shoulder member 31. The shoulder member 31 is provided at the end portion of the valve body 23 that is positioned within the central receiving cavity 30 and has a central projection 18 for centering the compression spring 21. The valve body 23 projects with an enlarged portion 32 into the injection chamber 28. Within the injection chamber 28 the enlarged portion 34 goes over into a thinner end portion 33.

Pressure is exerted upon the enlarged portion 32 by the fuel entering the injection chamber 28, and the valve body 23 is thereby pushed back against the force of the compression spring 21. The nozzle openings 24 are thus released so that the fuel can enter the combustion chamber.

As soon as the annular groove 13 of the control piston 1 has passed the second annular groove 14 of the housing means 3, the connecting bore 12 is no more connected to the relief valve 15. Subsequent to passing the control edge, an increased pressure P2 acts upon the control piston 1 and leads to a further opening of the injection valve 4 arranged downstream. Accordingly, a larger fuel quantity can be injected into the combustion chamber during this second pressure stage. Subsequently, the control piston 1 is again displaced to the stop 6 by the force of the spring 5 and a new cycle is initiated.

Via a back pressure valve 20 provided within the distribution plate 17, fuel is taken in from a fuel container (not illustrated) during the return stroke of the pistons 1, 10 through a bore opening 34 within the threaded socket member 19 and within the insertion member 22. The fuel reaches the second bore 11 via the distribution plate 17 so that it can be conveyed to the nozzle openings 24 during the next stroke of the pressure intensifying piston 10 in the manner described. The opening 34 also opens into the central receiving cavity 30. During the return stroke of the pressure intensifying piston 10 the back pressure valve 20 is opened up by the low pressure that is created whereby the fuel is taken in.

The pressure regulator for controlling the pre-injection quantity therefore operates in two stages. During the first stage, the pressure $p_1$ acting upon the control piston 1 is decreased by the relief valve 15 such that first only a decreased pressure corresponding to the setting of the relief valve acts upon the control valve 1. In accordance with this decreased pressure, also the injection valve 4 arranged downstream is opened by the pressure intensifying piston 10. As soon as the annular groove 13 of the control piston 1 has passed the second annular groove 14 of the housing means 3, the connection between the connecting bore 12 and the relief valve 15 is interrupted so that the fill, increased pressure now acts upon the control piston 1. Accordingly, the injection valve 4 is farther opened by the pressure intensifying piston 10. Thus, a specified quantity of fuel can be conveyed while the duration of the control action and the pressure exerted remain constant.

The pressure regulation described is a variation of pressure which, depending on the respective setting, leads to two consecutive output signals which differ time-wise and hydraulically when a hydraulic input signal is prescribed time-wise. A precision control of the pre-injection (pilot injection) is achieved by means of the pressure regulator which is integrated into the injection system. The two-stage attitude is achieved by a simple sliding control having a single input signal ($p_1$).

Figure 8:
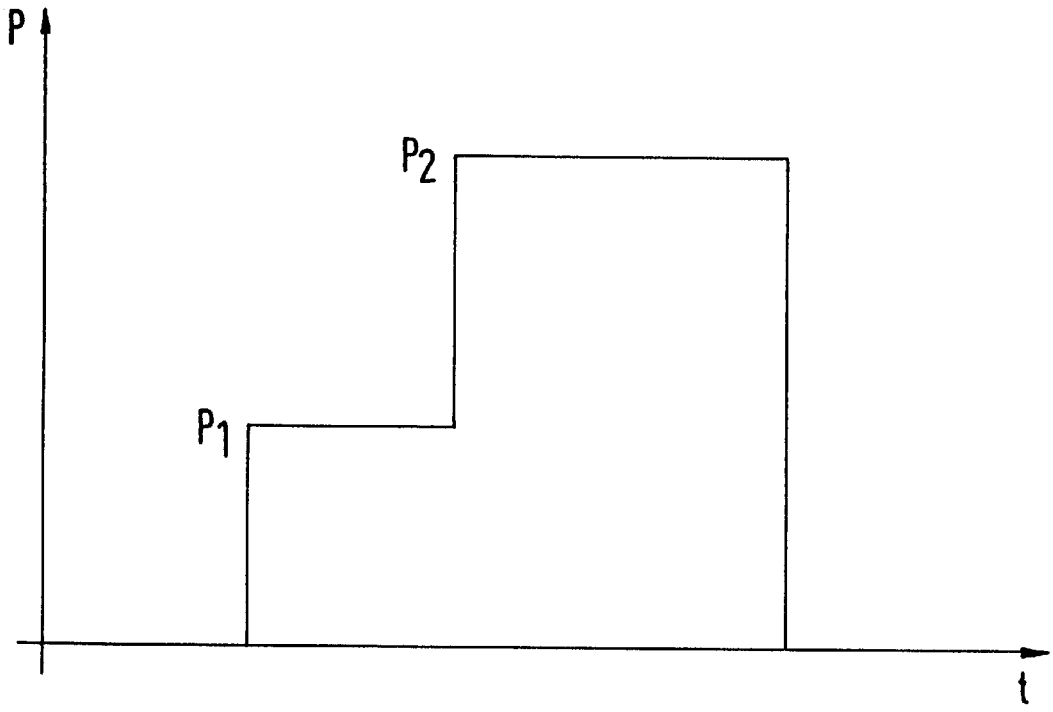
FIG. 8 shows a pressure-time-characteristic of the inventive pressure regulator.

Instead of the annular groove 13, the control piston 1 can also be provided with a transverse bore leading from the connecting bore 12 to the wall surface of the control piston 1. Also the housing means 3 can be provided with a bore instead of the second annular groove 14 whereby the bore has connection to the relief valve 15. When both annular grooves 13, 14 are utilized, the transition between the two different pressures occurs almost abruptly. FIG. 8 shows the corresponding pressure-time diagram. The pressure increase occurs suddenly. If bores are provided instead of the annular grooves, the transition between the different pressures occurs more steadily.

Figure 2:
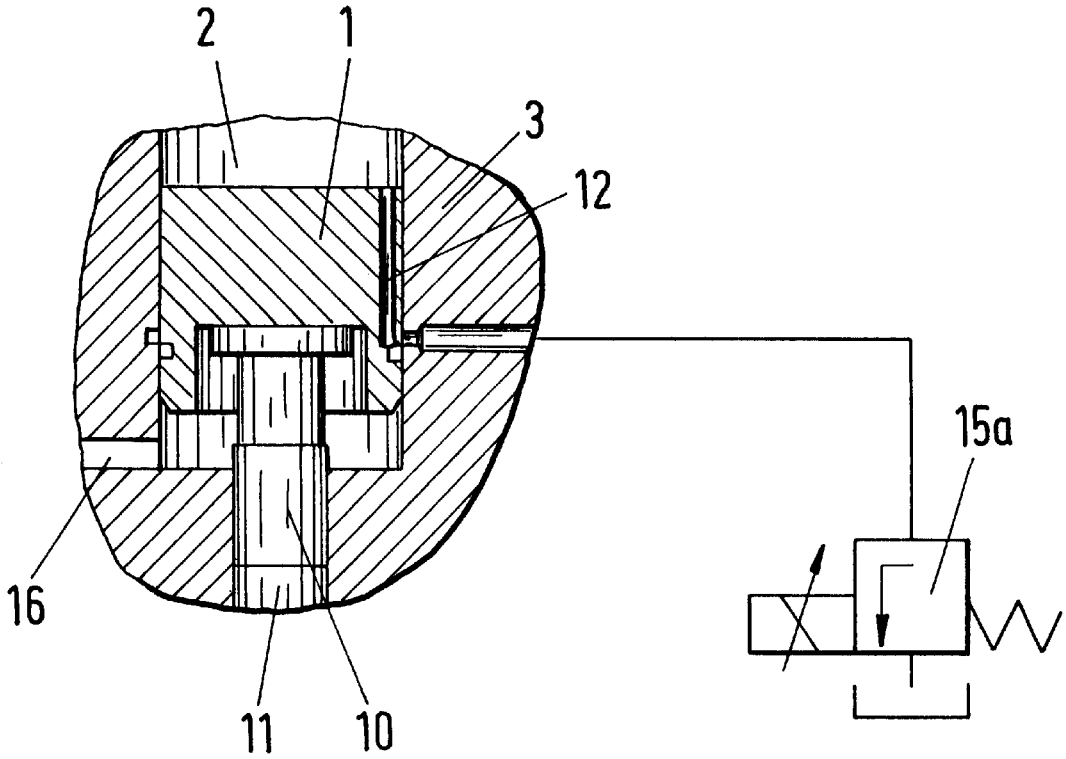
FIGS. 2 through FIG. 7 each, show further embodiments of an inventive pressure regulator in longitudinal sections.
Figure 3:
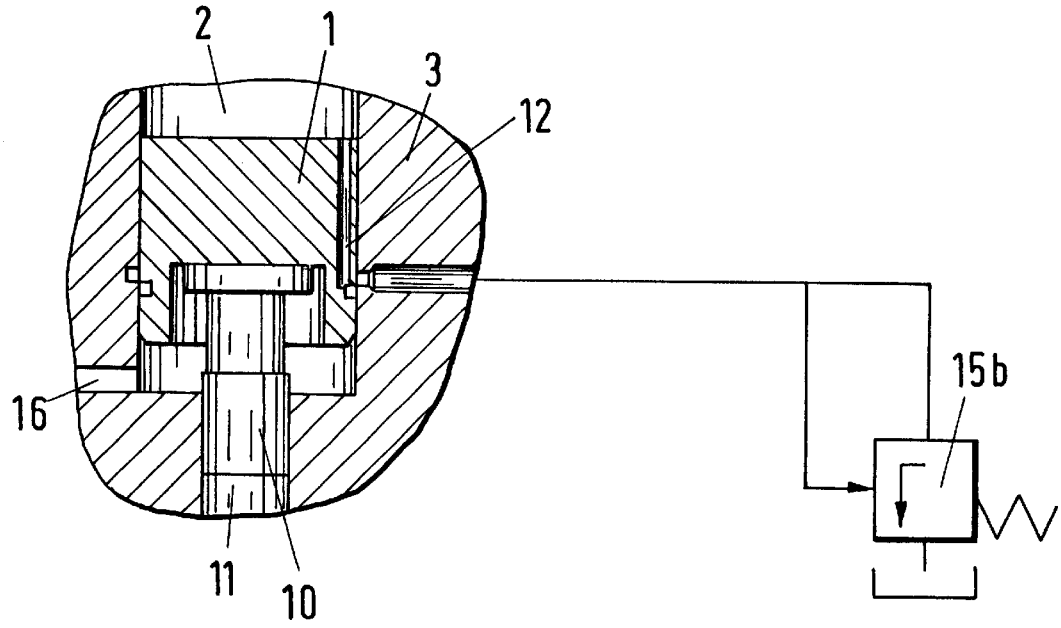
Figure 4:
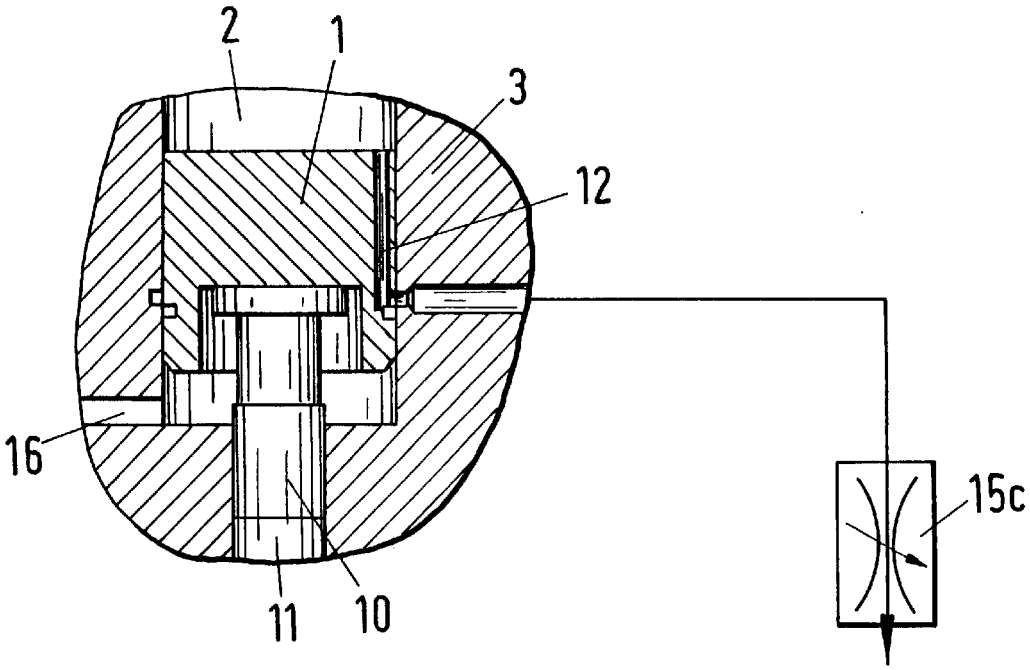

The embodiments according to FIGS. 2 to 4 differ from the embodiment according to FIG. 1 only by the type of pressure regulator utilized. In the embodiment according to FIG. 2, the pressure regulating device is a magnetic relief valve 15*a* Also with the magnetic relief valve 15*a*, the desired decreased pressure can be set in a simple way. The pressure regulator operates like the embodiment according to FIG. 1.

In the embodiment according to FIG. 3, the pressure regulating device is a pre-controlled pressure-regulating valve 15*b*. Otherwise, this relief valve operates like the embodiment according to FIG. 1.

Finally, in the embodiment according to FIG. 4, an adjustable restrictor 15*c* is utilized.

The pressure-regulating device can also be embodied to be unalterable, e.g., in the form of a throttle or a restriction.

However, it is also possible, as the described embodiments show, to embody the pressure-regulating device to be adjustable.

Figure 5:
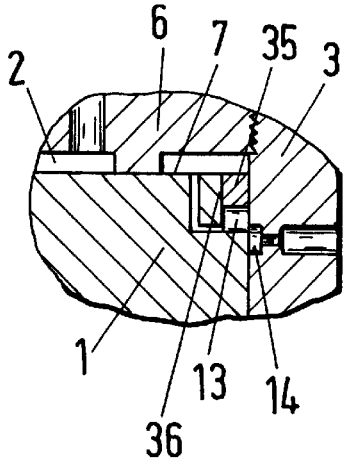

In order that the control edges of the annular grooves 13, 14 are precisely adjusted to each other, it is possible to select, prior to assembling, the housing means 3 and the control piston 1 that match each other. FIG. 5 illustrates the possibility to adjust the control edge of the control piston 1 with an adjustable threaded ring 35 in a precise manner. The threaded ring 35 is screwed into an annular opening 36 within the piston surface 7. Because of the screw connection, the control edge of the annular groove 13 which is formed by the bottom surface of the threaded ring 35 is precisely adjustable with respect to the second annular groove 14.

Figure 6:
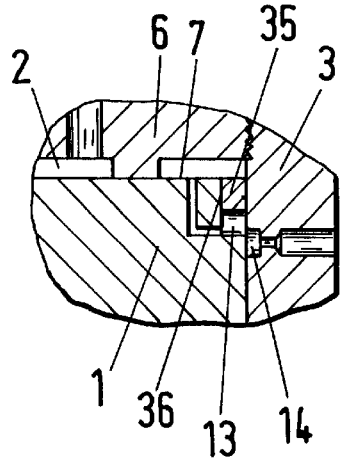

In the embodiment according to FIG. 6, the ring 35 is pressed into the annular opening 36. Thus, the leading edge of the control piston 1 is also precisely adjustable. A subsequent adjustment as in the case of the threaded ring 35 according to FIG. 5 is, however, not possible.

Figure 7:
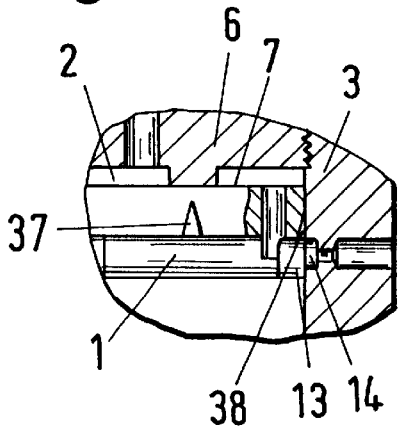

The control piston 1 according to FIG. 7 is provided at its periphery with precision-control notches 37 with the aid of which the injection process can be precisely adjusted. The precision-control notches 37 can also be provided within the wall of the bore 2. By the design of the precision-control notches 37, it is achieved that the transition between the individual pressures does not occur abruptly (FIG. 8) but, depending on the design of the precision-control notches, smoothly. The precision-control notches 37 are arranged in such a way that they start at the level of the control edge 38 of the control piston 1 and continuously decrease in their diameter in the direction of the stop 6. In the longitudinal sectional view according to FIG. 7, the precision-control notches 37 have a triangular shape. Such precision-control notches 37 are advantageously utilized where structural members cannot be acted upon by abrupt pressure changes.

In the embodiments described, the pilot valve 26 is switched by means of the control unit 25 into the position illustrated in FIG. 1 for carrying out the backstroke of the intensifying piston 10 and of the control piston 1. During the back stroke, the hydraulic medium within the bore 2 is displaced to the tank T via the pressure connection and the pilot valve 26.

It is possible, to entirely open up the relief valve 15, 15*a* to 15*c* by the control unit 25. In that event, a portion of the hydraulic medium can flow back to the tank T through the connecting bore 12 and the annular grooves 13, 14 and by means of the open relief valve 15. Thus, the hydraulic medium can drain very quickly.

By the pressure regulators described a constructively simple sliding control is created by which the pre-injection quantity of fuel can be produced in an easy manner and reliably. If the combustion engine operates within the partial throttle range or at idle, a pre-injection of fuel is sufficient. If the combustion engine, however, operates within the full throttle range, only a main injection occurs. The type of injection is controlled by the control unit 25.

The present invention is, of course, in no way restricted to the specific disclosure of the specification and drawings, but also encompasses any modifications within the scope of the appended claims.

What is claimed is:

1. A pressure regulator for controlling a pre-injection quantity of fuel in internal combustion engines, comprising:

a housing means;

a control piston provided with said housing means and a relief valve for controlling a pressure level on an injection valve, whereby said relief valve in a first position of said control piston is connected to said control piston for producing a decreased pressure on said injection valve, and whereby in a second position of said control piston said relief valve is separated from said control piston for producing a higher pressure, said control piston provided with at least one connecting bore which is connected to a line which is connected to said relief valve, said connecting bore extending from a piston surface to which pressure is applied to an annular groove or a transverse bore provided on a peripheral surface of said control piston or opening into said surface, wherein said annular groove within said control piston is delimited by a threaded ring or a press-fit ring.

2. A pressure regulator according to claim 1, wherein said line is an annular groove or a bore within said housing means.

3. A pressure regulator according to claim 1, wherein said at least one connecting bore of said control piston is line-connected to the line in said first position of said control piston.

4. A pressure regulator according to claim 1, wherein said relief valve is provided within said housing means.

5. A pressure regulator according to claim 1, wherein said relief valve is provided externally of said housing means.

6. A pressure regulator according to claim 1, wherein said relief valve is provided within said control piston.

7. A pressure regulator according to claim 1, which includes means for adjusting said relief valve.

8. A pressure regulator according to claim 1, wherein said relief valve is provided with a fixed pressure value.

9. A pressure regulator according to claim 1, wherein said relief valve is a pressure control valve.

10. A pressure regulator according to claim 1, wherein said relief valve is a pressure regulating valve.

11. A pressure regulator according to claim 1, wherein said relief valve is a throttle.

12. A pressure regulator according to claim 1, which is provided with a pressure transferring/intensifying piston which is arranged downstream of said control piston, and which has a pressure ($p_2$) for activating said injection valve.

13. A pressure regulator according to claim 1, wherein control notches are provided in a peripheral surface of said control piston or in a wall of a housing bore receiving said control piston.

14. A pressure regulator according to claim 1, wherein said threaded ring or said press-fit ring is adjustable.

* * * * *